US007273025B2

(12) United States Patent
Neudorfer

(10) Patent No.: US 7,273,025 B2
(45) Date of Patent: Sep. 25, 2007

(54) CAMSHAFT ADJUSTER HAVING A MEANS FOR SECURING AGAINST MODIFICATION

(75) Inventor: Gordon Neudorfer, Ulm (DE)

(73) Assignee: Hydraulik-Ring GmbH, Marktheidenfeld (Altfeld) (DE)

( * ) Notice: Subject to any disclaimer, the term of this patent is extended or adjusted under 35 U.S.C. 154(b) by 0 days.

(21) Appl. No.: 11/248,508

(22) Filed: Oct. 12, 2005

(65) Prior Publication Data

US 2006/0112920 A1 Jun. 1, 2006

(30) Foreign Application Priority Data

Oct. 12, 2004 (DE) ..... 10 2004 049 785

(51) Int. Cl.
*F01L 1/34* (2006.01)

(52) U.S. Cl. ..... 123/90.17; 123/90.31; 464/160

(58) Field of Classification Search ..... 123/90.15, 123/90.16, 90.17, 90.18, 90.27, 90.31; 464/1, 464/2, 160
See application file for complete search history.

(56) References Cited

U.S. PATENT DOCUMENTS 3,405,595 A 10/1968 Peterson
6,634,842 B2 * 10/2003 Ueno ..... 411/377
6,871,621 B2 * 3/2005 Palesch et al. ..... 123/90.17

FOREIGN PATENT DOCUMENTS

| | | |
|---|---|---|
| DE | 1475201 | 3/1969 |
| DE | 7819061 | 12/1979 |
| DE | 8813890 | 12/1988 |
| DE | 19756015 | 6/1994 |
| DE | 29510069 | 8/1995 |
| DE | 29609863 | 8/1996 |
| DE | 29811498 | 9/1998 |
| DE | 10253883 | 5/2004 |
| DE | 102004012460 | 10/2005 |
| JP | 2002168217 | 6/2002 |

* cited by examiner

*Primary Examiner*—Ching Chang
(74) *Attorney, Agent, or Firm*—Haynes and Boone, LLP

(57) ABSTRACT

Camshaft adjusters which work in accordance with the operating principle of a hydraulic oscillating motor comprise at least two components arranged parallel to one another. Frequently, the two components are a covering plate and a stator. The two components are connected by fasteners which penetrate through one of the two components. At least one of the fasteners is equipped with a central, deformable pin which, in the obstructed state, impedes the nondestructive separation of the two components arranged parallel to one another.

9 Claims, 2 Drawing Sheets

CAMSHAFT ADJUSTER HAVING A MEANS FOR SECURING AGAINST MODIFICATION

CROSS REFERENCE

This application claims priority to German application number 10 2004 049 785.0-12, filed Oct. 12, 2004.

BACKGROUND OF THE INVENTION

The invention relates to a fastener which is suitable for holding together camshaft adjusters. The invention furthermore relates to a camshaft adjuster.

Camshaft adjusters are motors which, on rotating about a central axis, can change the position of a camshaft connected to them, i.e. rotate the camshaft through an angle. Camshaft adjusters exist in various embodiments, as electric motors, as hydraulic motors and as mechanical gear transmissions. Camshaft adjusters which work on the hydraulic basis of an oscillating motor are widespread. Owing to the hydraulic pressure between two components movable relative to one another, e.g. a rotor and a stator, the camshaft can be rotated in its position with respect to a further shaft, such as, for example, a crankshaft or a second camshaft. The oscillating motor swivels the camshaft between an advanced position and a retarded position, each of which is assigned a relative adjustment angle with respect to the second shaft. Such camshaft adjusters have the form of a vane-type motor.

The components movable relative to one another, i.e. the stator and rotor, form one or more hydraulic chambers which can be tightly closed off hydraulically from the environment by a further component, such as, for example, a cover or a toothed wheel or a chain wheel, so that oil can be led into the chambers only via defined inlets and outlets, lines or ducts.

Depending on the configuration, the compact camshaft adjuster which is sealed off from the outside, except for the inlet and outlet lines, still has numerous other components, such as, for example, one or more springs, a locking pin and many other components.

It can be gathered, from DE 197 56 015 A1 for example, what the structure of a suitable camshaft adjuster looks like, the latter having an annular piston for fixing the rotational position. A somewhat different structure can be gathered from DE 102 53 883 A1, in which, inter alia, a locking element in the proposed camshaft adjuster is described. From DE 10 2004 012 460 it can be learnt how a spiral spring can be arranged in a camshaft adjuster in order to implement a locking characteristic. The smooth running of the rotor can be influenced by further special measures. All the described camshaft adjusters with their individual components and embodiments are incorporated in the patent application for reasons of simplification by these references.

It is therefore evident that it is in the interest of people who modify engines and get power reserves from the engines by tampering with the engine control (so-called tuners) to know the exact structure of a camshaft adjuster and to permanently manipulate the behavior of the camshaft adjuster and thus the entire engine by fitting other, similarly acting replacement components. The modifications and manipulations shorten the service life of the engine. Despite the tampering, claims of recourse are then frequently made to the manufacturers of motor vehicles and through them to the manufacturers of camshaft adjusters. It is frequently difficult for the manufacturer of a camshaft adjuster to reliably prove the manipulations.

SUMMARY OF THE INVENTION

It is therefore desirable to mark the camshaft adjuster such that tampering and manipulations can be easily recognized even by personnel with little training. Furthermore, the intention of a camshaft adjuster with the marking is to impede the manipulation by the tuners.

From DE 88 13 890.9U there is known a screw locking means, the screw head of which can be torn off. From DE 78 19 061U there is known a screw for preventing theft of license plates which is built up at the surface. From DE 296 09 863 U1 there is known a screw locking means, the weak point of which can be shaped by upsetting into an outwardly directed bulge. All the known screw locking means have the disadvantage that they develop or upset the screw in a direction which is not available as construction space for camshaft adjusters.

In addition, for completeness, mention should be made of the following publications, DE 298 11 498 U1, DE 295 10 069 U1, DE 1 475 201 A and U.S. Pat. No. 3,405,595 A, which provide modified screws because the screwing operation with customarily known screws is awkward and difficult.

From JP 2002168217A there is known a screw head which, through a pin integrated in the head, provides a locking function in that no conventional tool is supposed to be able to engage in the screw head any more. The pin, which constitutes the blocking element, ends below the end of the screw head. However, a screwing tool which has a central recess is still able to alter the screw tightening torque.

It therefore seems desirable to develop the existing knowledge such that, particularly when applied to a camshaft adjuster, an even greater effort must be made to conceal tampering with the fastened-together workpiece, such as, for example, with a camshaft adjuster.

Initial attempts of the inventors which involved the use of color marking were not successful, because there are embodiments in which the outside of the camshaft adjuster lies in an oil bath. The hot engine oil here washes off the marking in the course of time.

This and other objects are achieved at least partly by a fastener of the generic type as claimed in claim 1. A corresponding camshaft adjuster is described in more detail in claim 2 and 8. Advantageous configurations can be gathered from the dependent claims.

Camshaft adjusters which work in accordance with the operating principle of a hydraulic oscillating motor comprise at least two components arranged parallel to one another. Frequently, the two components are a covering plate and a stator. The stator may be a housing-forming stator which not only performs the stator function but is also part of the housing of the camshaft adjuster as well. The two components are connected by fasteners which penetrate through one of the two components. The fasteners may be distributed at uniform intervals over the surface of the housing. At least one of the fasteners is equipped with a central, deformable pin which, in the obstructed state, impedes the nondestructive separation of the two components arranged parallel to one another. The central, deformable pin is located such that it can be permanently deformed. To enable the two components to be separated again using normal tools, the pin has to be returned to its undeformed state, i.e. re-formed. During this procedure, the pin may break off. To make things more difficult, the tool for loosening cannot be put directly onto the fastener. First, the pin has to be adapted such that the tool for loosening can come into engagement with the fastener. Repeated deformation leaves behind permanent changes in the structure of the central pin. The changes are either visible with the naked eye or they can be proved by X-ray analysis. Since the fasteners are not available on the open market, a clever tuner would have to copy the fasteners himself in order to make the tampering invisible. This too makes it more difficult to cover up the tampering with the camshaft adjuster.

Technically favorable fasteners are those which are classical countersunk screws, but with a deformable pin arranged in the screw head. The pin is formed in the direction opposite the screw shank. Consequently, the pin can easily be marked after assembly of the camshaft adjuster. To separate the components of the camshaft adjuster, however, the pin is again difficult to pull out of the screw and it can be drawn out in an elongated manner only with difficulty. In the course of the deformation, the pin is caulked or upset in the direction of the screw shank. In a deformed state, the pin lies below the surface of the screw head.

After the pin has been deformed, the pin may lie centrally in a deformation space. The deformation space and the engagement space for the loosening tool may be identical. The deformation space merges into a profile which can positively receive a torque transmitter, in particular a hexagon socket head. Particularly if both spaces are at least partly identical, the deformed pin blocks the space in which the tool can engage. The profile is no longer directly accessible.

The pin in the deformed state is stamped by a pattern which is visibly marked in particular from the top side of the fasteners by stamping. The viewer can easily recognize the stamping. The term stamping means all shaping patterns, from a simple notch to complicated, multilayer patterns, which may also bear seal marks.

If the camshaft adjuster is equipped with a chain wheel or a toothed wheel, the teeth run around the outside of the round surface of the camshaft adjuster. The fasteners run at right angles to teeth of an encircling toothed wheel formed in one piece with one of the two components, which brace the two components arranged parallel to one another. At right angles is to be understood here as meaning that the fasteners do not have to run only at a 90° angle to the surface defined by the chain wheel, but angles differing slightly from 90°, e.g. 85° or 100°, are also included.

Using a torque wrench which is suitable for screwing together at least two components of a camshaft adjuster, the camshaft adjuster is screwed together. The torque wrench is a hollow torque transmitter, the cavity of which can receive the deformable pin. Furthermore, the torque wrench is equipped with a striking pin in the inner region of the torque transmitter, which is provided with a stamping pattern at its tip. The stamping pattern stamps a shape copying the pattern into the central pin. It acts like a seal.

BRIEF DESCRIPTION OF THE DRAWING

The described invention can be understood even better by reference to the drawings, in which.

DESCRIPTION OF PREFERRED EMBODIMENTS

Figure 1:
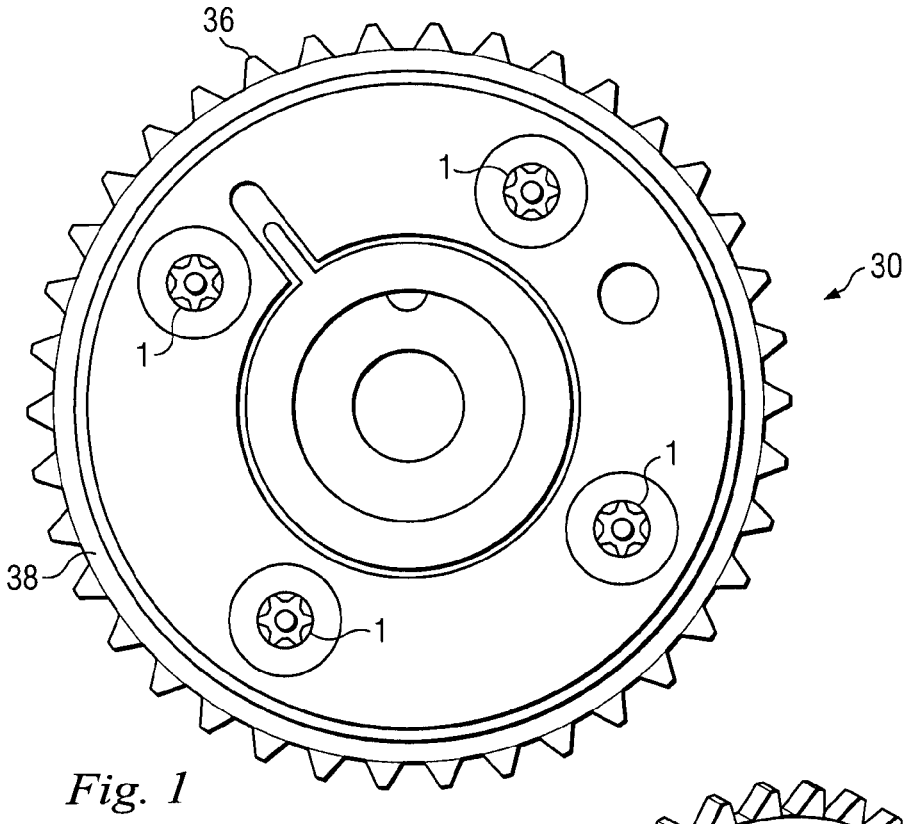
FIG. 1 depicts a camshaft adjuster in a first view.
Figure 2:
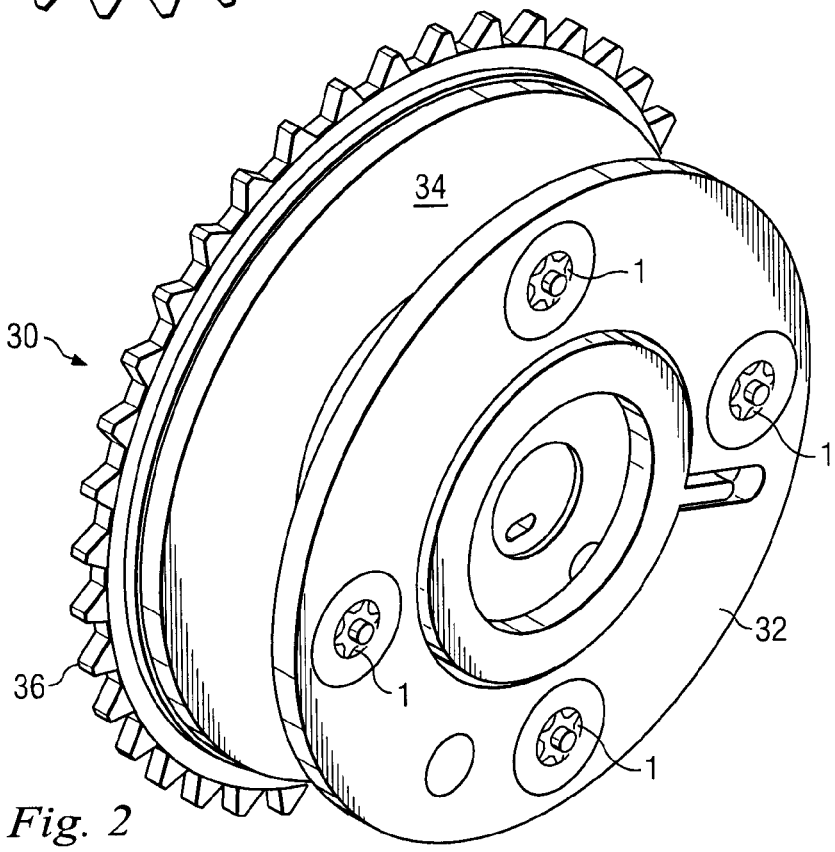
FIG. 2 depicts the camshaft adjuster in a second view.

In FIG. 1 a camshaft adjuster 30 of a conventional type is depicted in plan view. The camshaft adjuster 30 has a toothed wheel 38 running around the outside and having a multiplicity of teeth 36, onto which toothed wheel can be placed a chain drive which establishes a connection between the adjuster and a driving shaft, such as a crankshaft or a second camshaft. In place of a drive of a chain and a toothed wheel, a belt drive on a running surface or a gear transmission may also be chosen. The camshaft comprises a plurality of components, as shown, for example, in FIG. 2. The depicted camshaft adjuster has a housing-forming stator as the main housing, referred to as the housing 34 below, and a covering plate 32. The component referred to as the housing forms the greatest part of the entire housing. On its own, it does not constitute the entire housing. The two components together form a hydraulic cavity which is closed off from the outside and has apertures to the outside via discharge and/or supply ducts for the hydraulic medium. The two components which outwardly bound the camshaft adjuster 30 in the form of an enclosure, i.e. the housing 34 and the covering plate 32, are held together by fasteners 1, which may be embodied as countersunk screws. There may equally well be embodiments in which a chain wheel, a covering and a transverse housing are screwed together. In the assembled state, the fasteners 1 completely disappear in the receiving components and form a uniform surface with the surface of the surrounding component, except in the inner region of the surface of the fastener, which is described in more detail below.

Figure 3:
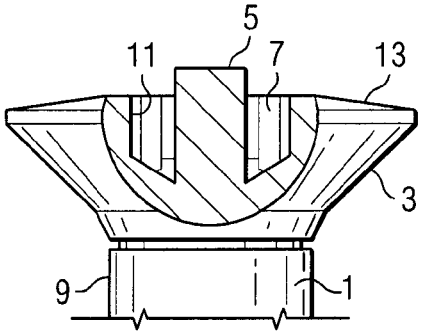
FIG. 3 depicts a fastener according to the invention for a camshaft adjuster shown in FIG. 2.
Figure 4:
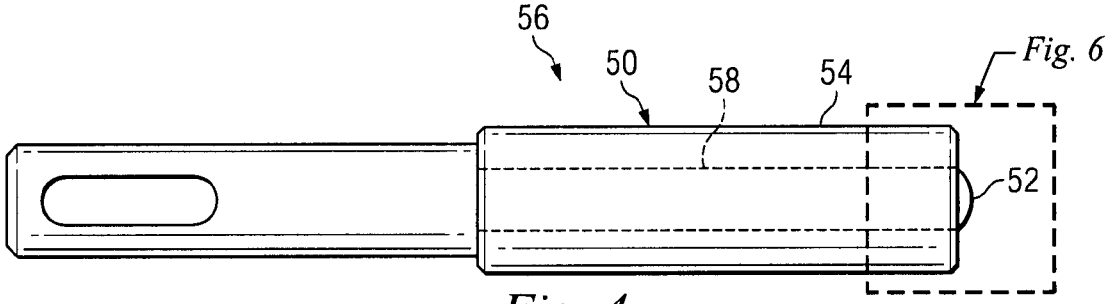
FIG. 4 depicts a torque transmitter with stamping pattern.
Figure 9:
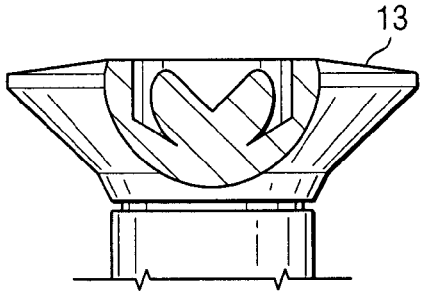
FIG. 9 depicts a fastener according to the invention, stamped with the pattern shown in FIG. 10 on a torque transmitter shown in FIG. 4.

In FIG. 3 a head 3 of a countersunk fastener 1 having a shank 9 is depicted. Where the countersunk fastener 1 is a screw, the screw head 3 merges in a reduced manner into a screw shank 9. Approximately at the centre of the screw head 3 is a pin 5 which protrudes from the head 3 and is surrounded by a deformation space 7, suitable for receiving a torque transmitter 50, as shown by way of example in FIG. 4. In the uncaulked state, the pin 5 projects in one configuration into the cavity 54 of the torque transmitter 50. According to another configuration, illustrated in FIG. 4, at one end of the torque transmitter 50 there is provided a pattern 52 present on an internally guided striking pin 58, by which a caulked formation in the manner of a seal can be imparted to the pin 5 pressed in the direction of the screw shank, as graphically revealed in FIGS. 5, 7, 9. In the configuration according to FIG. 5, the pin 5 has been centrally caulked with the pattern 52 according to FIG. 6.

Figure 7:
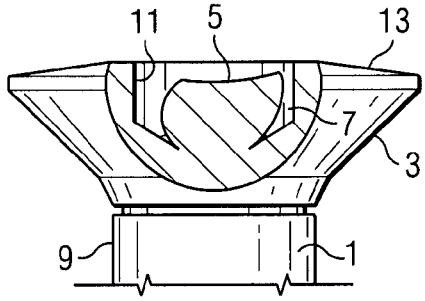
FIG. 7 depicts a fastener according to the invention, stamped with the pattern shown in FIG. 8 on a torque transmitter shown in FIG. 4.
Figure 8:
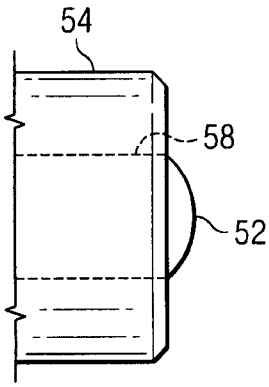
FIG. 8 depicts a stamping pattern.

The caulked form of the pin 5 has a very uniform appearance. The pattern 52 according to FIG. 8 lies a little off-center. It produces a caulked pin according to FIG. 7 which extends into the deformation space 7. To enable suitable torque transmitters 50 still to be inserted into the screw head 3 around the pin 5 after deformation, part of the pin 5 has to be removed from the deformation space 7. Given appropriate porosity of the material of the pin 5, of the entire screw head 3 or of the entire fastener 1, the pin 5 breaks upon subsequent re-formation. Tampering with the screw is evident.

Figure 5:
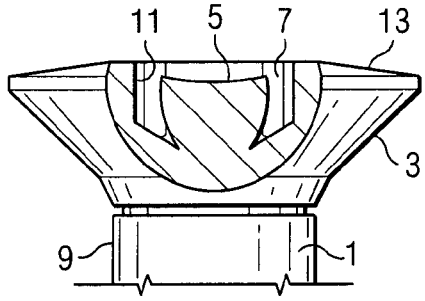
FIG. 5 depicts a fastener according to the invention, stamped with the pattern shown in FIG. 6 on a torque transmitter shown in FIG. 4.
Figure 6:
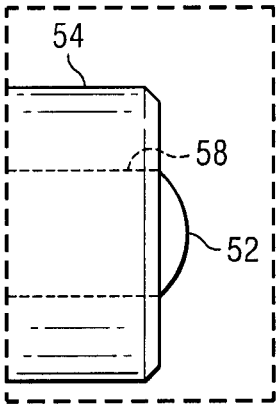
FIG. 6 depicts a stamping pattern.
Figure 10:
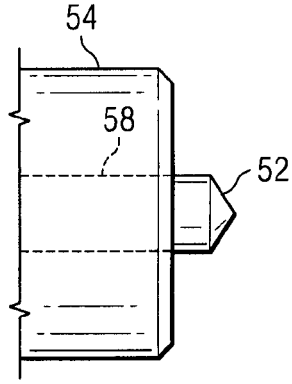
FIG. 10 depicts a stamping pattern.

In the case of a deformation according to FIG. 5 by a caulking tool according to FIG. 6, tampering with the pin 5 or with the screw head 3 can be visualized by detection means, such as an X-ray apparatus or structural analysis of the pin. A further variant of the caulking is formed by a tool according to FIG. 10 with a pattern 52 which tapers to a midpoint or a saddle. The pin 5 in the screw head 3 has the corresponding notch in its caulking, a visually attractive and easily definable stamped pattern 60. The stamped pattern 60 is formed by means of the striking pin 58, which may be part of the torque wrench 56.

List of Reference Symbols

| Reference symbols | Names |
|---|---|
| 1 | fastener/countersunk screw |
| 3 | screw head |
| 5 | pin |
| 7 | deformation space |
| 9 | screw shank |
| 11 | profile |
| 13 | top side (of the fasteners) |
| 30 | camshaft adjuster |
| 32 | covering plate |
| 34 | housing |
| 36 | tooth |
| 38 | toothed wheel |
| 50 | torque transmitter |
| 52 | pattern |
| 54 | cavity |
| 56 | torque wrench |
| 58 | striking pin |
| 60 | stamped pattern |

The invention claimed is:

1. A camshaft adjuster having a covering plate component extending over a housing component; wherein the improvement comprises a fastener for fastening the covering plate to the housing, the fastener comprising:

a head of the fastener extending in an aperture in one of the components, the head having an opening for receiving a transmitter for transmitting torque to the head;

a deformable pin formed integrally with the head and located in a portion of the opening for engagement by a striking member of the transmitter; and a shank extending from the head and adapted to threadedly engage the other component when the torque is transmitted to the head, to fasten the components together, whereby the pin is deformable within the opening in response to the striking member of the transmitter engaging the pin.

2. The fastener of claim 1 wherein the deformed pin provides a visual indication that the torque transmitter has engaged the head.

3. The fastener of claim 1 wherein the torque transmitter extends in a space between the outer surface of the pin and the inner wall of the head defining the opening.

4. The fastener of claim 3 wherein the deformed pin extends into the space.

5. The fastener of claim 3 wherein the wall of the head is hexagonal to form a socket for receiving the torque transmitter.

6. The fastener of claim 5 wherein the hexagonal wall receives a hexagonal outer wall of the torque transmitter and wherein the pin is engaged by a striking pin formed on the torque transmitter.

7. The fastener of claim 6 wherein the striking pin on the torque transmitter crushes the pin.

8. The fastener of claim 6 wherein the striking pin on the torque transmitter stamps a pattern on the pin.

9. The fastener of claim 6 wherein the striking pin on the torque transmitter forms a notch on the pin.

* * * * *